US006719405B1

(12) United States Patent
Powers

(10) Patent No.: US 6,719,405 B1
(45) Date of Patent: Apr. 13, 2004

(54) INKJET PRINTHEAD HAVING CONVEX WALL BUBBLE CHAMBER

(75) Inventor: James H. Powers, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 9 days.

(21) Appl. No.: 10/396,623

(22) Filed: Mar. 25, 2003

(51) Int. Cl.[7] ..... B41J 2/05
(52) U.S. Cl. ..... 347/62; 346/65
(58) Field of Search ..... 347/56, 62, 63, 347/65

(56) References Cited

U.S. PATENT DOCUMENTS

| | | | | |
|---|---|---|---|---|
| 4,720,716 | A | * 1/1988 | Ikeda et al. | 347/64 |
| 5,455,613 | A | 10/1995 | Canfield et al. | |
| 5,508,725 | A | 4/1996 | Goto et al. | |
| 5,694,684 | A | 12/1997 | Yamamoto | |
| 5,719,604 | A | 2/1998 | Inui et al. | |
| 5,757,400 | A | 5/1998 | Hoisington | |
| 5,808,641 | A | 9/1998 | Miyagawa et al. | |
| 5,815,185 | A | 9/1998 | Pietrzyc | |
| 5,867,192 | A | 2/1999 | Mantell et al. | |
| 6,042,222 | A | 3/2000 | Moritz, III et al. | |
| 6,120,139 | A | 9/2000 | Childers et al. | |
| 6,183,078 | B1 | 2/2001 | Pietrzyc et al. | |
| 6,296,350 | B1 | 10/2001 | Cornell et al. | |
| 6,299,673 | B1 | 10/2001 | Field et al. | |
| 6,328,421 | B1 | 12/2001 | Kojima et al. | |
| 6,364,467 | B1 | 4/2002 | Blair et al. | |
| 6,398,850 | B1 | 6/2002 | Field et al. | |
| 6,422,690 | B1 | 7/2002 | Harvey et al. | |
| 6,447,104 | B1 | 9/2002 | Keil et al. | |
| 6,457,812 | B1 | 10/2002 | Silverbrook | |
| 6,460,971 | B2 | 10/2002 | Silverbrook | |
| 6,505,916 | B1 | 1/2003 | Silverbrook | |
| 2002/0055048 | A1 | 12/2001 | Lee et al. | |
| 2002/0033868 | A1 | 3/2002 | Ohashi et al. | |
| 2002/0063756 | A1 | 5/2002 | Tsuchii et al. | |

* cited by examiner

*Primary Examiner*—Michael S. Brooke
(74) *Attorney, Agent, or Firm*—King & Schickli, PLLC

(57) ABSTRACT

In an inkjet printhead, a substantially rectangular heater element has a length and width dimension defining an aspect ratio of more than about 2.0. A bubble chamber with a curved or convex wall portion partially surrounds the heater element. A radius of an arc defining the convex wall portion is greater than one-half the width dimension while less than one-half the length dimension and none of the convex wall portion overlies a periphery of the heater element. An ink ejection orifice exists through a thickness of a nozzle plate covering the bubble chamber and resides above the heater element. Additionally, the bubble chamber may have a rectangular wall portion connected to the convex wall portion and either portion may occupy a terminal end of the bubble chamber. Preferred length and width dimensions include 35 and 13 or 40 and 10 microns with a radius of about 16 microns.

20 Claims, 6 Drawing Sheets

INKJET PRINTHEAD HAVING CONVEX WALL BUBBLE CHAMBER

FIELD OF THE INVENTION

The present invention relates to inkjet printheads. In particular, it relates to an arrangement of a bubble chamber having a curved or convex wall portion partially surrounding a rectangular heater element.

BACKGROUND OF THE INVENTION

The art of inkjet printing is relatively well known. In general, an image is produced by emitting ink drops from a printhead at precise moments such that they impact a print medium at a desired location. The printhead is supported by a movable print carriage within a device, such as an inkjet printer, and is caused to reciprocate relative to an advancing print medium and emit ink drops at times pursuant to commands of a microprocessor or other controller. The timing of the ink drop emissions corresponds to a pattern of pixels of the image being printed. Other than printers, familiar devices incorporating inkjet technology include fax machines, all-in-ones, photo printers, and graphics plotters, to name a few.

A conventional thermal inkjet printhead includes access to a local or remote supply of color or mono ink, a heater chip, a barrier layer, a nozzle or orifice plate attached or formed with the heater chip, and an input/output connector, such as a tape automated bond (TAB) circuit, for electrically connecting the heater chip to the printer during use. The heater chip, in turn, typically includes a plurality of thin film resistors or heater elements fabricated by deposition, masking and etching techniques on a substrate such as silicon.

To print or emit a single drop of ink, an individual heater is uniquely addressed with a predetermined amount of current to rapidly heat a small volume of ink. This causes the ink to vaporize in a local bubble chamber (between the heater and nozzle plate) and to be ejected through the nozzle plate towards the print medium. The shape of the ink chamber often conforms to the shape and orientation of its attendant heater.

Problematically, when both the heater and bubble chamber have rectangular shapes, stagnant regions can develop in the bubble chamber and serve to trap air bubbles in the ink. Over time, trapped bubbles accumulate and grow large enough to prevent proper heat transfer. Eventually, the heaters fail or have lessened functionality.

Accordingly, a need exists to prevent air bubble formation and accumulation in inkjet printheads.

SUMMARY OF THE INVENTION

The above-mentioned and other problems become solved by applying the principles and teachings associated with the hereinafter described printhead having a curved wall bubble chamber.

In one embodiment, the invention teaches an inkjet printhead with a substantially rectangular heater element. By dividing a length by a width dimension, the heater element has an aspect ratio of more than about 2.0. More preferably, it has an aspect ratio of about 4.0 or 5.0 or greater than about 2.5. A bubble chamber with a curved or convex wall portion partially surrounds the heater element. A radius of an arc of the curved wall portion is greater than the width dimension of the heater element while less than the length dimension and none of the curved wall portion overlies a periphery of the heater element. In other embodiments, the radius is greater than one-half the width dimension while less than one-half the length dimension and none of the convex wall portion overlies a periphery of the heater element. An ink ejection side of an orifice, which exists through a thickness of a nozzle plate covering the bubble chamber, resides directly above the heater element. Preferred length and width dimensions include about 35 and 13 microns or 40 and 10 microns with a radius of about 16 microns. The bubble chamber may be formed in the nozzle plate, in a plurality of layers defining the heater chip or in a barrier layer between the nozzle plate and the heater chip.

In other aspects of the invention, the bubble chamber includes a rectangular wall portion connected to the convex wall portion and either portion may occupy a terminal end of the bubble chamber. Comer regions of the rectangular portion may include chamber cuts, fillet cuts or other.

In either bubble chamber embodiment, an ink flow channel through one of the bubble chamber walls has a primary direction of ink flow substantially paralleling a length dimension of the heater element. Two substantially parallel ink flow walls define the primary direction and are oriented substantially parallel to the length dimension and substantially perpendicular to a longitudinal extent of an ink via. Similar to the bubble chamber, the ink flow channel may be formed in the nozzle plate, in a plurality of layers defining the heater chip or in a barrier layer between the nozzle plate and the heater chip.

Inkjet printers for housing the printheads are also disclosed.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION OF THE PREFERRED EMBODIMENTS

In the following detailed description of the preferred embodiments, reference is made to the accompanying drawings that form a part hereof, and in which is shown by way of illustration, specific embodiments in which the inventions may be practiced. These embodiments are described in sufficient detail to enable those skilled in the art to practice the invention, and it is to be understood that other embodiments may be utilized and that process or other changes may be made without departing from the scope of the present invention. The following detailed description is, therefore, not to be taken in a limiting sense and the scope of the present invention is defined only by the appended claims and their equivalents. In accordance with the present invention, an inkjet printhead bubble chamber having curved wall portions is hereinafter described.

Figure 1A:
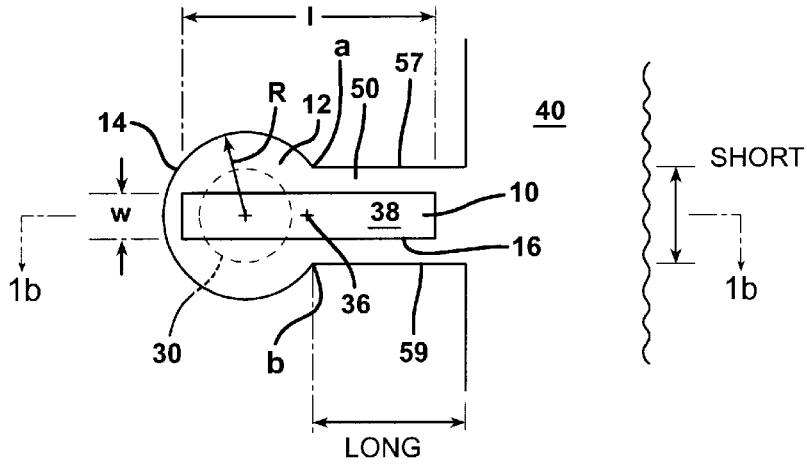
FIG. 1*a* is a diagrammatic top view in accordance with the teachings of the present invention of an inkjet printhead bubble chamber having a curved or convex wall portion.
Figure 1B:
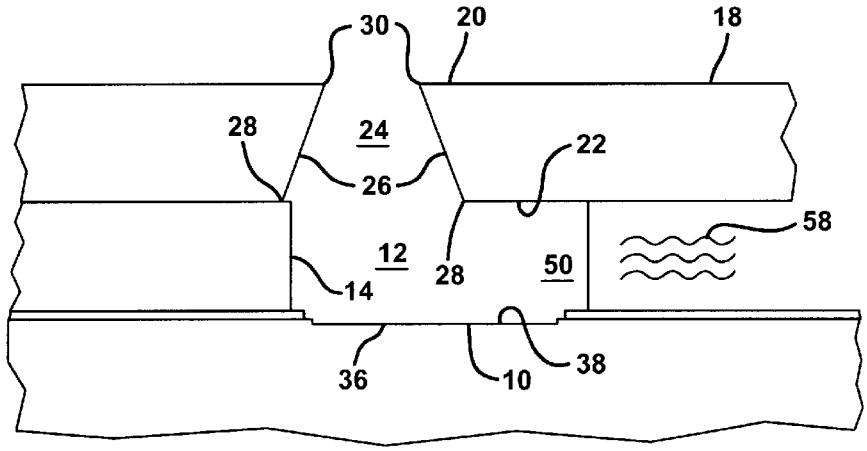
FIG. 1*b* is a partial side view of the inkjet printhead bubble chamber of FIG. 1*a* taken along line 1*b*—1*b;*

With reference to FIGS. 1*a* and 1*b*, a heater element 10 for heating ink in an inkjet printhead has a substantially rectangular shape defined by a periphery 16 with a length l and width w dimension. In one embodiment, an aspect ratio of the length dimension to the width dimension is greater than about 2.0. In another embodiment, the aspect ratio is greater than about 2.5. Preferably, the length dimension is about 35.6 microns while the width dimension is about 13.2 microns. In still another embodiment, the aspect ratio is about 4.0. Specifically, the length dimension is about 40 microns while the width dimension is about 10 microns. In still other embodiments, the aspect ratio is about 5.0 or more.

Surrounding a portion of the heater element is a bubble chamber 12 having a curved wall portion 14. In cross section (FIG. 1*b*), the curved walls 14 rise above the heater element 10 to provide a chamber in which ink can become heated to form a bubble as is well know in the art. A radius R defines a size of the bubble chamber. In this embodiment, since the curved wall portion nearly defines a complete circle, the radius corresponds to the radius of the arc as between points a and b in a counterclockwise direction. In one embodiment this radius is about 16 microns. Specifically, it is about 15.5 microns.

As a result, the radius of the arc exceeds the width dimension of the heater element while not exceeding the length dimension. More particularly, the radius exceeds more than one-half the width dimension while not exceeding one-half the length dimension. In this manner, the curved wall portion of the bubble chamber does not either completely surround the heater element nor does it mimic the shape of the heater element as with prior art designs. Further, appreciating the orientation of the bubble chamber as generally above the surface 38 of the heater element, skilled artisans should notice that none of the curved wall portion overlies a periphery or any other portion of the heater element unlike various prior art bubble chamber designs.

Figure 7:
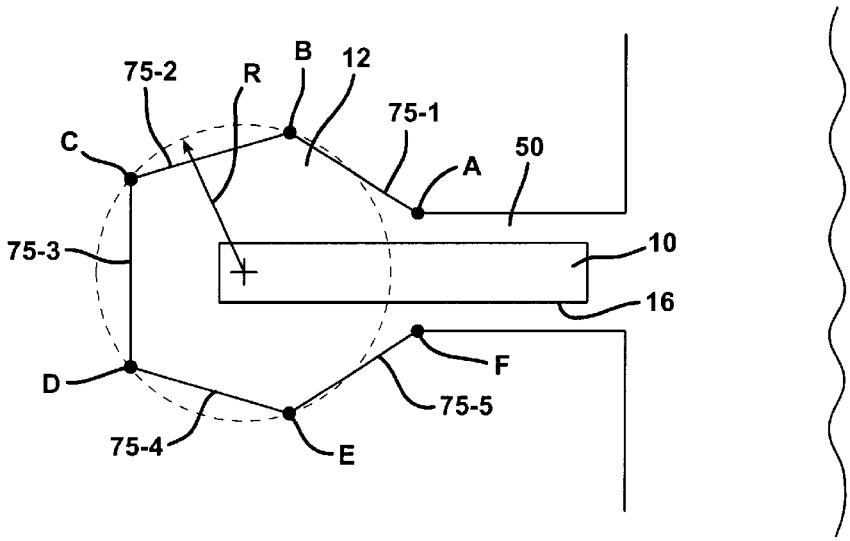
FIG. 7 is a diagrammatic view in accordance with the teachings of the present invention of an alternate embodiment of inkjet printhead bubble chamber having a convex wall port ion.

In still other embodiments, the curved wall portion might not embody a circle. For example, with reference to FIG. 7, the curved wall portion may be approximated through formation of a series of straight wall segments 75-1 through 75-5 as between points A through F. Accordingly, the curved wall portion may alternatively be referred to as a convex wall portion (convex being a term relative to a position of the heater element in the bubble chamber) and may consist of generally rounded or curved walls or as a series of substantially straight walls approximating a curve. With such convex wall portions, a radius R of a circular arc that passes nearly through all points A–F still defines the size of the bubble chamber and R is still greater than the width dimension of the heater element and less than the length dimension. It is also greater than one-half the width dimension and less than one-half the length dimension. Although five straight walls have been shown, other embodiments contemplated by this invention include wall segments of three, four, six walls or more. Those skilled in the art will appreciate that the more straight walls a bubble chamber has, the better the approximation of a circular arc having a radius R. Conversely, skilled artisans will appreciate that fewer straight lines will yield a lesser approximation and a circular arc might only pass through two of the points defining the straight line segments.

Above the bubble chamber is a nozzle plate 18 formed as a series of polymer or other layer(s) or as a discrete component fastened by epoxy or the like. In one embodiment, the nozzle plate has a first surface 20 and a second surface 22 that define a thickness thereof. Axially extending through the nozzle plate from the second to the first surface is an orifice 24 for ejecting and projecting ink during use. Preferably, but not necessarily a requirement, the shape of the orifice comprises a frustum conical shape defined by sloping walls 26 having a large diameter opening 28 at one end thereof and a small diameter opening 30 at the other, ink ejection end thereof. For convenience, FIG. 1*a* shows the location of the small diameter opening 30 in phantom relative to the heater element and the bubble chamber. As seen, the small diameter opening of the orifice 24 resides directly above a surface 38 of the heater element, albeit offset from a center 36. As a representative example of size, present day printheads have small diameter openings on the order of about 11 or 14 microns. In the future, it is expected that this dimension will gradually shrink as printing resolutions increase from 600 DPI (dots-per-inch) to 900 or 1200 DPI or more. In other embodiments, the nozzle plate attaches to a barrier layer that overlies the layers of the heater element.

Further connected to the bubble chamber, through a wall thereof on a side of the bubble chamber closest to an ink via 40, is an ink flow channel 50 having a long and short dimension of about 22 microns and 18 microns, respectively. Two substantially parallel walls 57, 59 define the ink flow channel and a primary direction of ink flow therein. The walls exist substantially perpendicular to a longitudinal extent of the ink via 40 and substantially parallel to the length dimension of the heater element. During use, ink 58 flows through the ink channel in a primary direction substantially paralleling the length dimension 1 of the heater element on the surface 38. Ink is ejected through the orifice 24 in a direction substantially transverse to the primary direction. Further operation of the printhead will be described below.

Figure 2:
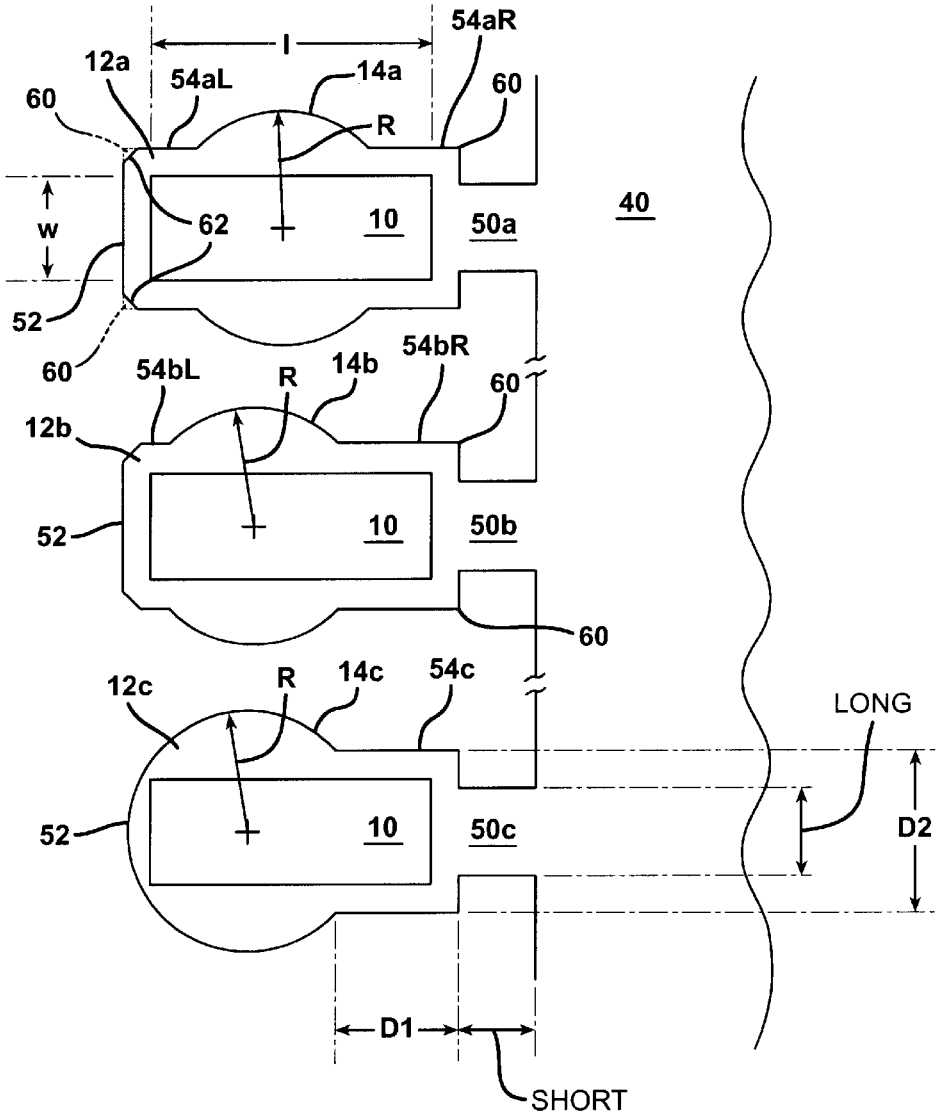
FIG. 2 is a diagrammatic view in accordance with an alternate embodiment of the present invention of an inkjet printhead bubble chamber having a circular curved wall portion and a rectangular wall portion.

With reference to FIG. 2, other embodiments of bubble chambers 12*a*–12*c* with curved wall portions 14*a*–14*c* include bifurcated or contiguous rectangular wall portions 54*a*L, 54*a*R, 54*b*L, 54*b*R, 54*c* (bifurcated portions have left and right halves designated with L and R letters) connected thereto with either portion occupying a terminal end 52 (the end furthest from the ink via 40) of the bubble chamber. In comparison to the embodiment of FIGS. 1*a*, 1*b*, skilled artisans should notice that between the curved or convex wall portions and the rectangular wall portions of the bubble chamber, the heater element 10 is substantially completely surrounded such that the heater element does not extend into the ink flow channel. In this manner, a differential pressure point is created where the ink flow channel 50 meets the rectangular wall portion 54. As such, it may also be preferred to change the orientation of the ink flow channel by swapping locations of the long and short dimensions as representatively shown with ink channel 50*c*.

As a further representative example, the rectangular wall portions may substantially mimic the periphery shape and orientation of the heater element and any of the rectangular wall portions 54 may have a distance D1, substantially paralleling the length dimension of the heater element, of about 22–26 microns. It may have a distance D2, substantially paralleling the width dimension of the heater, of about 25–29 microns. For the bifurcated rectangular wall designs, a printhead designer merely apportions the distance D1 on the left and right sides of the curved wall portion (14*a* or 14*b*) according to desire.

In other aspects of the invention, any, all or some of the corner regions 60 of the rectangular wall portion of the bubble chamber may have chamfer cuts 62 to essentially round-off an otherwise perpendicular comer. In one embodiment, the chamfer cuts are approximately 45 degrees from the primary direction of ink flow through the ink channel 50 and exist on only the two rightmost comer regions 60. In other embodiments, fillets may replace the chamfer cuts on any, some or all of the comer regions.

Figure 3:
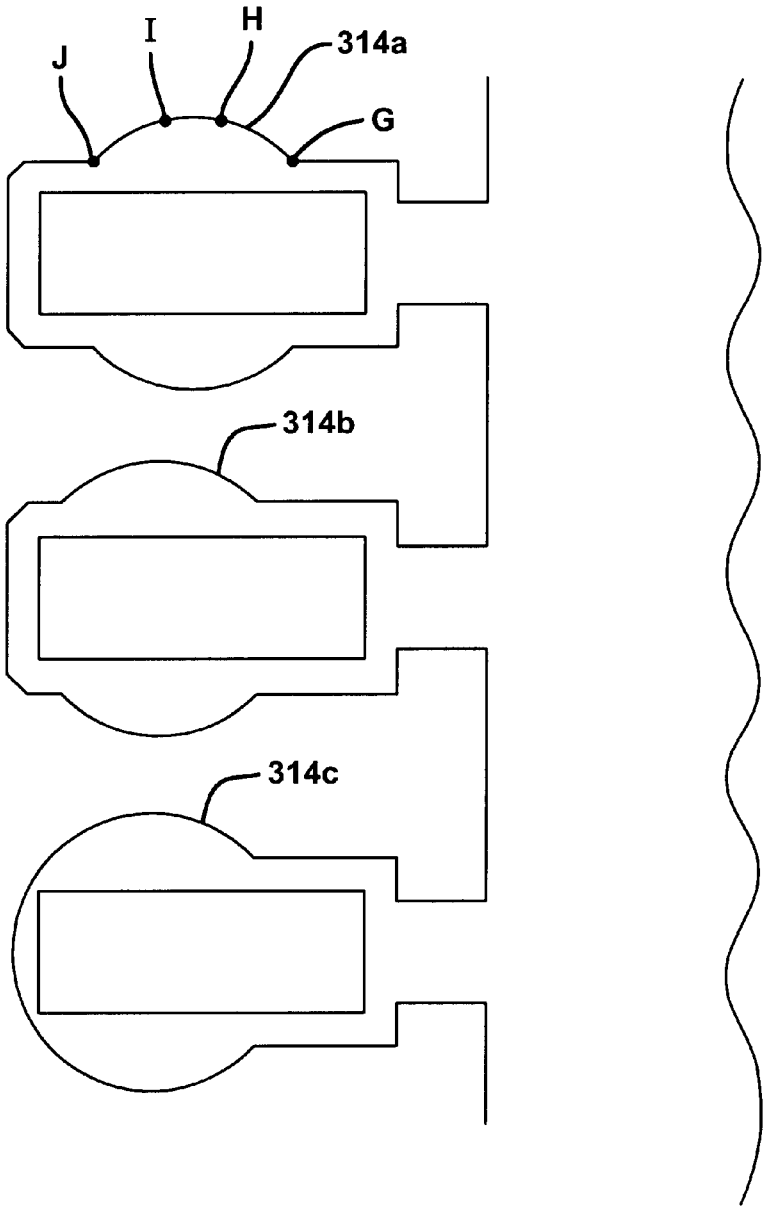
FIG. 3 is a diagrammatic view in accordance with an alternate embodiment of the present invention of an inkjet printhead bubble chamber having an oval convex wall portion and a rectangular wall portion.

FIG. 3 differs from FIG. 2 in only the shape of the curved or convex wall portion. Specifically, the curved wall portions 314*a*–314*c* of FIG. 3 correspond to portions of ovals instead of circle portions. With an oval, however, a radius greater than the width of the heater element and shorter than the length dimension only exists for arc portions between points G and H and I and J because a straight line essentially exists between points H and I. Neither embodiment, however, should limit the curved wall portion to a particular shape, size or arc radius nor should it limit its position relative to the heater element resident in the bubble chamber. Even further, it should be appreciated that the oval shape could also be approximated using a series of substantially straight wall segments comparable to those of FIG. 7. It could also be approximated with straight wall segments giving rise to more than one arc portion.

Figure 6:
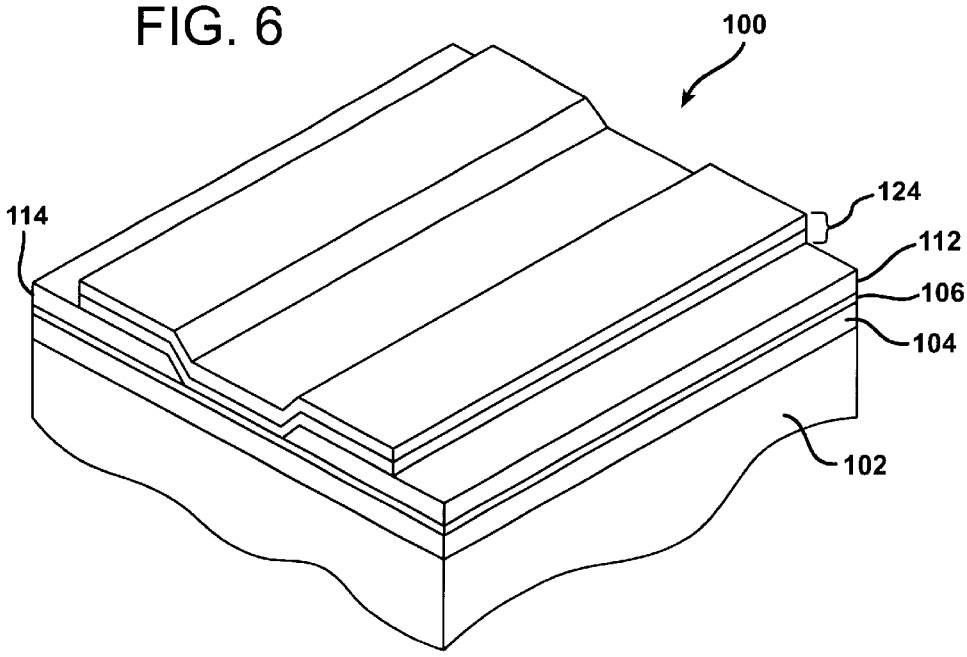
FIG. 6 is a perspective view in accordance with the teachings of the present invention of a plurality of thin film layers of a heater chip forming a heater element.

Appreciating that an individual heater element is one of many heater elements on a heater chip, skilled artisans know the economy of scale achieved by fabricating heater elements as thin film layers on a substrate through a series of growth layers, deposition layers, masking, patterning, photolithography, and/or etching or other processing steps. In a preferred embodiment (FIG. 6), the thin film layers of a heater chip 100 include, but are not limited to: a base substrate 102 (including any base semiconductor structure such as silicon-on-sapphire (SOS) technology, silicon-on-insulator (SOI) technology, thin film transistor (TFT) technology, doped and undoped semiconductors, epitaxial layers of silicon supported by a base semiconductor structure, as well as other semiconductor structures known or hereinafter developed); a thermal barrier layer 104 on the substrate; a heater or resistor layer 106 on the thermal barrier layer; a conductor layer (bifurcated into positive 112 and negative electrode 114 sections, i.e., anodes and cathodes) on the resistor layer to heat the resistor layer through thermal conductivity during use; passivation layer(s) 124, such as SiC and/or SiN; and an overlying cavitation layer on the passivation layer(s). By incorporation by reference, co-pending application Ser. No. 10/146,578, entitled "Heater Chip Configuration for an Inkjet Printhead and Printer," filed May 14, 2002 and having common assignee (Lexmark attorney docket 2001-0699.01), teaches suitable layers and stable ink jetting energy ranges relevant to the instant invention.

In various embodiments of thin film processing, the layers become deposited by any variety of chemical vapor depositions (CVD), physical vapor depositions (PVD), epitaxy, ion beam deposition, evaporation, sputtering or other similarly known techniques. Preferred CVD techniques include low pressure (LP), atmospheric pressure (AP), plasma enhanced (PE), high density, plasma (HDP) or other. Preferred etching techniques include, but are not limited to, any variety of wet or dry etches, reactive ion etches, deep reactive ion etches, etc. Preferred photolithography steps include, but are not limited to, exposure to ultraviolet or x-ray light sources, or other known or hereinafter developed technologies.

In still other embodiments, the substrate comprises a silicon wafer of p-type, 100 orientation, having a resistivity of 5–20 ohm/cm. Its beginning thickness is preferably, but not necessarily required, any one of 525+/−20 microns, 625+/−20 microns, or 625+/−15 microns with respective wafer diameters of 100+/−0.50 mm, 125+/−0.50 mm, and 150+/−0.50 mm.

The thermal barrier layer overlying the substrate includes a silicon oxide layer mixed with a glass such as BPSG, PSG or PSOG with an exemplary thickness of about 0.5 to about 3 microns, especially 1.82+/−0.15 microns. This layer can be deposited or grown according to manufacturing preference.

The heater element layer on the thermal barrier layer is about a 50–50% tantalum-aluminum composition layer of about900 or 1000 angstroms thick. In other embodiments, the resistor layer includes essentially pure or composition layers of any of the following: hafnium, Hf, tantalum, Ta, titanium, Ti, tungsten, W, hafniuum-diboride, $HfB_2$, Tantalum-nitride, $Ta_2N$, TaAl(N,O), TaAlSi, TaSiC, Ta/TaAl layered resistor, Ti(N,O), WSi(O) and the like.

The conductor layer overlying portions of the heater layer includes an anode and a cathode with about a 99.5–0.5% aluminum-copper composition of about 5000+/−10% angstroms thick. In other embodiments, the conductor layer includes pure aluminum or diluted compositions of aluminum with 2% copper or aluminum with 4% copper.

Figure 4:
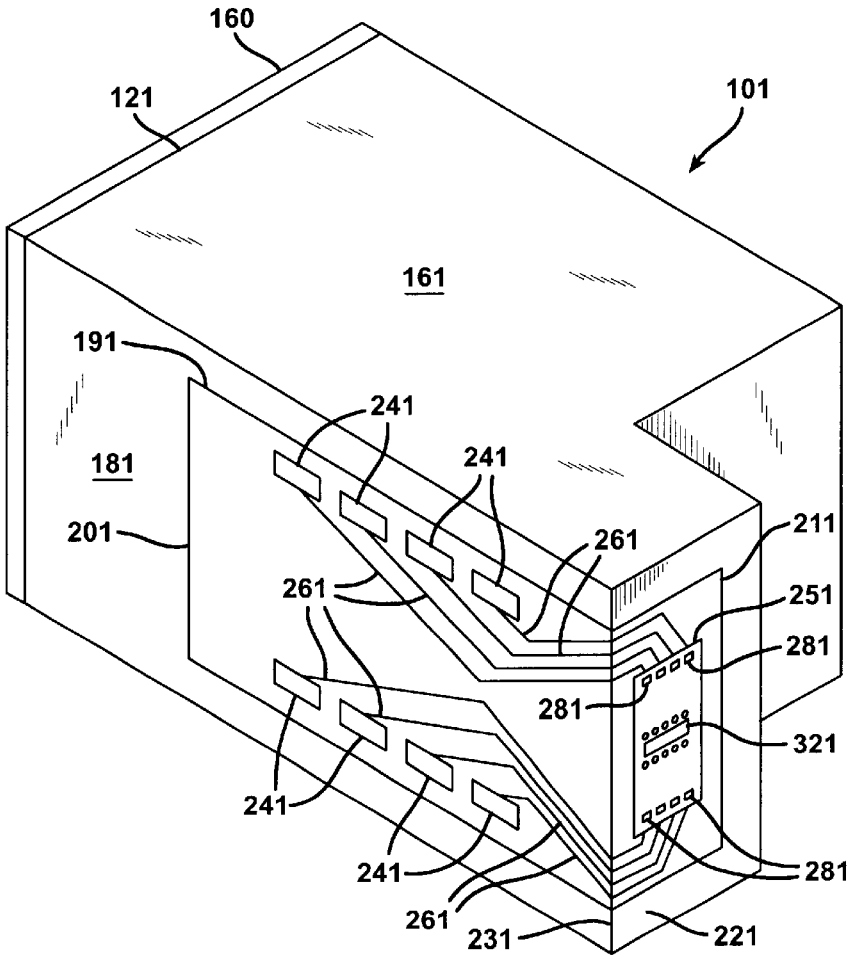
FIG. 4 is a perspective view in accordance with the teachings of the present invention of an inkjet printhead with a heater chip having a bubble chamber with a convex wall portion.

With reference to FIG. 4, a printhead of the present invention is shown generally as 101. The printhead 101 has a housing 121 formed of a body 161 and a lid 160. Although shown generally as a rectangular solid, the housing shape varies and depends upon the external device that carries or contains the printhead. The housing has at least one compartment, internal thereto, for holding an initial or refillable supply of ink and a structure, such as a foam insert, lung or other, maintains an appropriate backpressure therein during use. In another embodiment, the internal compartment includes three chambers for containing three supplies of ink, especially cyan, magenta and yellow ink. In other embodiments, the compartment may contain black ink, photo-ink and/or plurals of cyan, magenta or yellow ink. It will be appreciated that fluid connections (not shown) may exist to connect the compartment(s) to a remote source of ink.

A portion 191 of a tape automated bond (TAB) circuit 201 adheres to one surface 181 of the housing while another portion 211 adheres to another surface 221. As shown, the two surfaces 181, 221 exist substantially perpendicularly to one another about an edge 231.

The TAB circuit 201 has a plurality of input/output (I/O) connectors 241 fabricated thereon for electrically connecting a heater chip 251 to an external device, such as a printer, fax machine, copier, photo-printer, plotter, all-in-one, etc., during use. Pluralities of electrical conductors 261 exist on the TAB circuit 201 to electrically connect and short the I/O connectors 241 to the bond pads 281 of the heater chip 251 and various manufacturing techniques are known for facilitating such connections. Skilled artisans should appreciate that while eight I/O connectors 241, eight electrical conductors 261 and eight bond pads 281 are shown, any number are possible and the invention embraces all variations. The invention also embraces embodiments where the number of connectors, conductors and bond pads do not equal one another.

The heater chip 251 contains at least one ink via 321 (alternatively: element 40) that fluidly connects the heater chip to a supply of ink internal to the housing. During printhead manufacture, the heater chip 251 preferably attaches to the housing with any of a variety of adhesives, epoxies, etc. well known in the art. As shown, the heater chip contains two columns of heater elements on either side of via 321. For simplicity in this crowded figure, dots or small circles depict the heater elements in the columns. In an actual printhead, hundreds or thousands of heater elements may be found on the printhead and may have various vertical and horizontal alignments, offsets or other. A nozzle plate (element 18, FIGS. 1*a*, 1*b*) with pluralities of orifices adheres over the heater chip such that the nozzle holes align with the heaters. Alternatively the nozzle plate becomes adhered to a barrier layer that overlies the heater chip.

Figure 5:
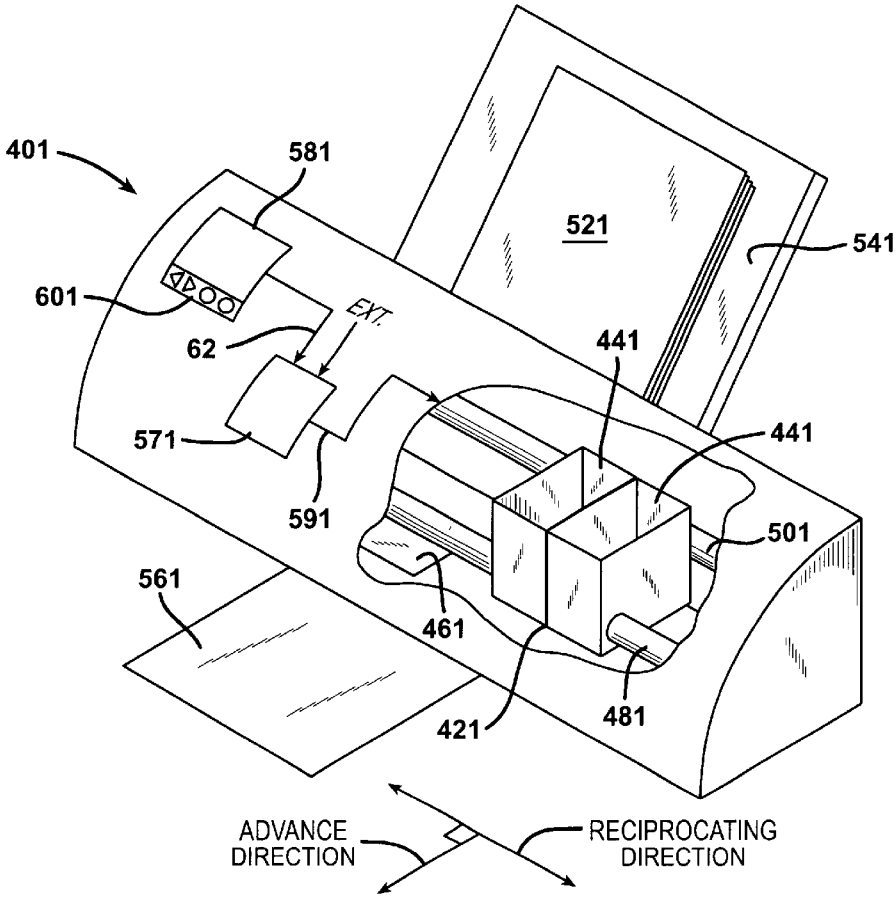
FIG. 5 is a perspective view in accordance with the teachings of the present invention of an inkjet printer for housing an inkjet printhead with a bubble chamber having a convex wall potion.

With reference to FIG. 5, an external device in the form of an inkjet printer contains the printhead 101 and is shown generally as 401. The printer 401 includes a carriage 421 having a plurality of slots 441 for containing one or more printheads. The carriage 421 is caused to reciprocate (via an output 591 of a controller 571) along a shaft 481 above a print zone 461 by a motive force supplied to a drive belt 501 as is well known in the art. The reciprocation of the carriage 421 is performed relative to a print medium, such as a sheet of paper 521, that is advanced in the printer 401 along a paper path from an input tray 541, through the print zone 461, to an output tray 561.

In the print zone, the carriage 421 reciprocates in the Reciprocating Direction generally perpendicularly to the paper Advance Direction as shown by the arrows. Ink drops from the printheads (FIG. 4) are caused to be ejected from the heater chip at such times pursuant to commands of a printer microprocessor or other controller 571. The timing of the ink drop emissions corresponds to a pattern of pixels of the image being printed. Often times, such patterns are generated in devices electrically connected to the controller (via Ext. input) that are external to the printer such as a computer, a scanner, a camera, a visual display unit, a personal data assistant, or other.

To print or emit a single drop of ink, a heater element is uniquely addressed with a short pulse of current to rapidly heat a small volume of ink. This vaporizes a thin layer of the ink on the heater surface; the resulting vapor bubble expels a column of ink out of the orifice and towards the print medium.

A control panel 581 having user selection interface 601 may also provide input 621 to the controller 571 to enable additional printer capabilities and robustness.

As described herein, the term inkjet printhead may in addition to thermal technology include piezoelectric technology, or other.

The foregoing description is presented for purposes of illustration and description of the various aspects of the invention. The descriptions are not intended to be exhaustive or to limit the invention to the precise form disclosed. The embodiments described above were chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed:

1. An inkjet printhead, comprising:

a substantially rectangular heater element having a periphery with a length and width dimension such that an aspect ratio of said length dimension to said width dimension is greater than about 2.0;

a bubble chamber having a convex wall portion partially surrounding said heater element, said convex wall portion having an arc with a radius that is greater than about 0.5 said width dimension and less than about 0.5 said length dimension and none of said convex wall portion overlies said periphery of said heater element; and a nozzle plate having a thickness with an orifice therein, an ink ejection side of said orifice being directly above said heater element.

2. The inkjet printhead of claim 1, further including an ink flow channel connected to said bubble chamber wherein said heater element extends into a portion of said ink flow channel.

3. The inkjet printhead of claim 1, wherein said bubble chamber further includes a rectangular wall portion fluidly connected to said convex wall portion.

4. The inkjet printhead of claim 3, wherein said rectangular wall portion has a corner region with a chamfer cut or fillet.

5. The inkjet printhead of claim 1, wherein said length dimension is about 35 microns, said width dimension is about 13 microns and said radius is about 16 microns.

6. The inkjet printhead of claim 1, wherein said length dimension is about 40 microns, said width dimension is about 10 microns and said radius is about 16 microns.

7. An inkjet printhead, comprising:

an ink via with a longitudinal extent;

a substantially rectangular heater element having a periphery with a length and width dimension such that an aspect ratio of said length dimension to said width dimension is greater than about 2.0, said width dimension being substantially parallel to said longitudinal extent;

a substantially straight ink flow channel fluidly connecting said heater element to said ink via, said ink flow channel having a primary direction of ink flow defined by two substantially parallel ink flow walls that are substantially parallel to said length dimension and substantially perpendicular to said longitudinal extent;

a bubble chamber fluidly connected to said ink flow channel, said bubble chamber having a curved wall portion partially surrounding said heater element, said curved wall portion having a radius of an arc that is greater than about 0.5 said width dimension and less than said length dimension and none of said curved wall portion overlies said periphery of said heater element; and a nozzle plate having a thickness with an orifice therein, an ink ejection side of said orifice being directly above said heater element.

8. The inkjet printhead of claim 7, wherein said aspect ratio is greater than about 2.5.

9. The inkjet printhead of claim 8, wherein said length dimension is about 35 microns, said width dimension is about 13 microns and said radius is about 16 microns.

10. The inkjet printhead of claim 7, wherein said aspect ratio is about 4.0.

11. The inkjet printhead of claim 10, wherein said length dimension is about 40 microns, said width dimension is about 10 microns and said radius is about 16 microns.

12. The inkjet printhead of claim 7, wherein said bubble chamber is formed said nozzle plate.

13. The inkjet printhead of claim 7, wherein said ink flow channel is formed in said nozzle plate.

14. The inkjet printhead of claim 7, wherein said ink ejection side of said orifice has a diameter of one of about 11 and 14 microns.

15. The inkjet printhead of claim 7, wherein said orifice has a frustum conical shape.

16. The inkjet printhead of claim 7, further including a supply of ink.

17. An inkjet printhead, comprising:

an ink via with a longitudinal extent;

a plurality of substantially rectangular heater elements each having a length and width dimension and a heater surface such that an aspect ratio of said length dimension to said width dimension is greater than about 2.5, said width dimension being substantially parallel to said longitudinal extent;

a plurality of substantially straight ink flow channels each fluidly connecting a single heater element of said plurality of heater elements to said ink via, said each ink flow channel having a primary direction of ink flow defined by two substantially parallel ink flow walls that are substantially parallel to said length dimension and substantially perpendicular to said longitudinal extent;

a plurality of bubble chambers each fluidly connected to a single ink flow channel of said plurality of ink flow channels, said each bubble chamber having a plurality of walls rising above said heater surface with both a convex wall portion and a rectangular wall portion that substantially surrounds said heater surface, said convex wall portion having a radius of an arc that is greater than about 0.5 said width dimension and less than about 0.5 said length dimension; and a nozzle plate having a plurality of orifices, each said orifice being above a portion of a single heater element of said plurality of heater elements.

18. The inkjet printhead of claim 17, wherein said convex wall portion resides on a terminal end of said bubble chamber.

19. The inkjet printhead of claim 17, wherein said rectangular wall portion resides on a terminal end of said bubble chamber.

20. The inkjet printhead of claim 19, wherein said rectangular wall portion has a chamfer cut in a corner region thereof.

* * * * *